US011559714B1

(12) United States Patent
Austin

(10) Patent No.: US 11,559,714 B1
(45) Date of Patent: Jan. 24, 2023

(54) PIERCING PIPE FIRE SUPPRESSION SYSTEM

(71) Applicant: Scott Austin, Tewksbury, MA (US)

(72) Inventor: Scott Austin, Tewksbury, MA (US)

( * ) Notice: Subject to any disclaimer, the term of this patent is extended or adjusted under 35 U.S.C. 154(b) by 0 days.

(21) Appl. No.: 17/528,363

(22) Filed: Nov. 17, 2021

(51) Int. Cl.
*A62C 35/68* (2006.01)
*A62C 3/02* (2006.01)

(52) U.S. Cl.
CPC ..... *A62C 35/68* (2013.01); *A62C 3/0214* (2013.01)

(58) Field of Classification Search
CPC ..... A62C 31/02; A62C 31/005; A62C 3/00; A62C 3/0214; A62C 35/86; A62C 35/68
See application file for complete search history.

(56) References Cited

U.S. PATENT DOCUMENTS

| | | | | |
|---|---|---|---|---|
| 4,485,877 | A * | 12/1984 | McMillan | B05B 1/02 169/48 |
| 4,697,740 | A * | 10/1987 | Ivy | A62C 31/22 169/70 |
| 5,913,367 | A * | 6/1999 | Hampton | A62C 31/22 169/70 |
| 10,610,715 | B1 * | 4/2020 | Taylor | A62C 31/22 |
| 2007/0034389 | A1 * | 2/2007 | Relyea | A62C 31/28 169/24 |
| 2019/0141916 | A1 * | 5/2019 | Auguste | A01G 25/06 239/201 |

* cited by examiner

*Primary Examiner* — Tuongminh N Pham
(74) *Attorney, Agent, or Firm* — Morse, Barnes-Brown & Pendleton, P.C.; Lisa M. Warren, Esq.

(57) ABSTRACT

A method and system are provided for an unmanned sprinkler system for suppressing fires that includes one or more hoses, one or more pipes, and a plurality of piercing nozzles arrayed and extending downward along each of the one or more pipes. Each of the piercing nozzles comprise a plurality of water flow openings for providing a sprinkler effect that suppresses or extinguishes fires.

14 Claims, 6 Drawing Sheets

PIERCING PIPE FIRE SUPPRESSION SYSTEM

BACKGROUND OF THE INVENTION

Extinguishing fires in structures is a very challenging and dangerous task. Buildings of different sizes, designs, construction methods/materials, occupancy classifications, and fuel loads make the task that much more difficult. No two fires or buildings are exactly the same, and the firefighting tactics and tools used to extinguish fires are forever evolving.

One of the biggest challenges is locating a fire in hard to access parts of a structure. Areas such as attics, crawl spaces, basements, void spaces above ceilings, and knee walls are difficult places to find and extinguish fires. A delay in finding a fire allows fire growth and spread, increases danger, and increases risk to firefighters. Hidden fire also causes further property damage until it can be located and extinguished. Applying water to a fire or cooling an atmosphere is the primary and best method of fire control and extinguishment. Cooling a smoke-filled superheated environment helps to prevent catastrophic fire events such as backdrafts and flashovers. Compartment fires can quickly reach over 1000 degrees Fahrenheit if not vented or cooled. Fires in confined spaces are especially at risk of intense heat buildup, and these areas must be cooled.

Operating on a roof is a significant part of firefighting and it is also a high-risk activity. Firefighters can fall from the roof and fire conditions inside can cause roof collapse. A tactic used by firefighters to reduce fire spread and decrease the interior temperature is to cut a ventilation hole in the roof. That is an effective tactic but it does not mitigate the incident or control the fire. Extinguishment and cooling with water is the best method to control fire. An effective fire protection system that has saved property for many years is the fire sprinkler system. Many attics and void spaces are not protected by sprinklers and rely on firefighters finding the fire, exposing it, and attempting to extinguish it. This is time consuming, dangerous, and often ineffective despite the best efforts of firefighters.

Fire appliances are typically capable of maximum water flow and are mounted to a fire apparatus, ladder trucks, and on the ground as master stream unmanned devices. Despite the many tools available to firefighters, few can penetrate building materials and cool or extinguish fire as an autonomous fire appliance in hard to access areas.

Handheld piercing nozzles have been used in the past by firefighters as a way of piercing building materials but require a firefighter's constant handling, which puts the firefighter at an increased risk. There is a need for a system that avoids these dangers while also being portable and offering rapid water flow like a master stream device.

SUMMARY OF THE INVENTION

The present invention overcomes these problems by providing a method and system for an unmanned sprinkler system for suppressing fires that includes one more hoses, one or more pipes, and a plurality of piercing nozzles arrayed and extending downward along each of the one or more pipes. Each of the piercing nozzles includes a plurality of water flow openings for providing a sprinkler effect as an effective means for fighting fires.

In an embodiment, the hose connected may be connected to a fire hydrant, fire apparatus or both.

In an embodiment, the system includes pipe(s) with at least one hose coupling to receive the hose on one end and a cap, a gate valve, and/or enclosure of the pipe on the other end. The bottom of the pipe has piercing nozzles that extend downward and feature openings for water flow.

In an embodiment, the pipe is designed to be deployed in difficult to access areas such as attics, basements, and other void spaces. The piercing nozzles are driven through building materials or placed in created holes, and into the enclosed area providing a rapid flow of pressurized water. A sprinkler system effect is created in spaces that do not have sprinkler protection. In an alternative embodiment, the system may be deployed in an area that does not require the use of the piercing nozzles such as at ground level or in an emergency decontamination corridor decontamination zone such as during a hazmat incident.

The system advantageously limits or controls the spread of fire, cools the heated atmosphere, and extinguishes or rapidly diminishes a fire, and advantageously shortens the time firefighters are exposed to risk. The system is quickly deployed by firefighters and can be operated autonomously. This provides the necessary fire suppression and lowers the risk to firefighters. The system can be part of a coordinated attack with ventilation and interior attack, transitional attack, or set up as a defensive means of protecting exposures from fire spread. For large roofs multiple pipes can be deployed to cover large expansive areas.

BRIEF DESCRIPTION OF THE DRAWINGS

In FIG. 5A, a side perspective of the fire suppression system wherein the second end comprises an enclosure is depicted. FIGS. 5B-5C depict enlarged views of the second end of the pipe with an enclosure or a cap, respectively.

DETAILED DESCRIPTION OF THE INVENTION

Figure 1:
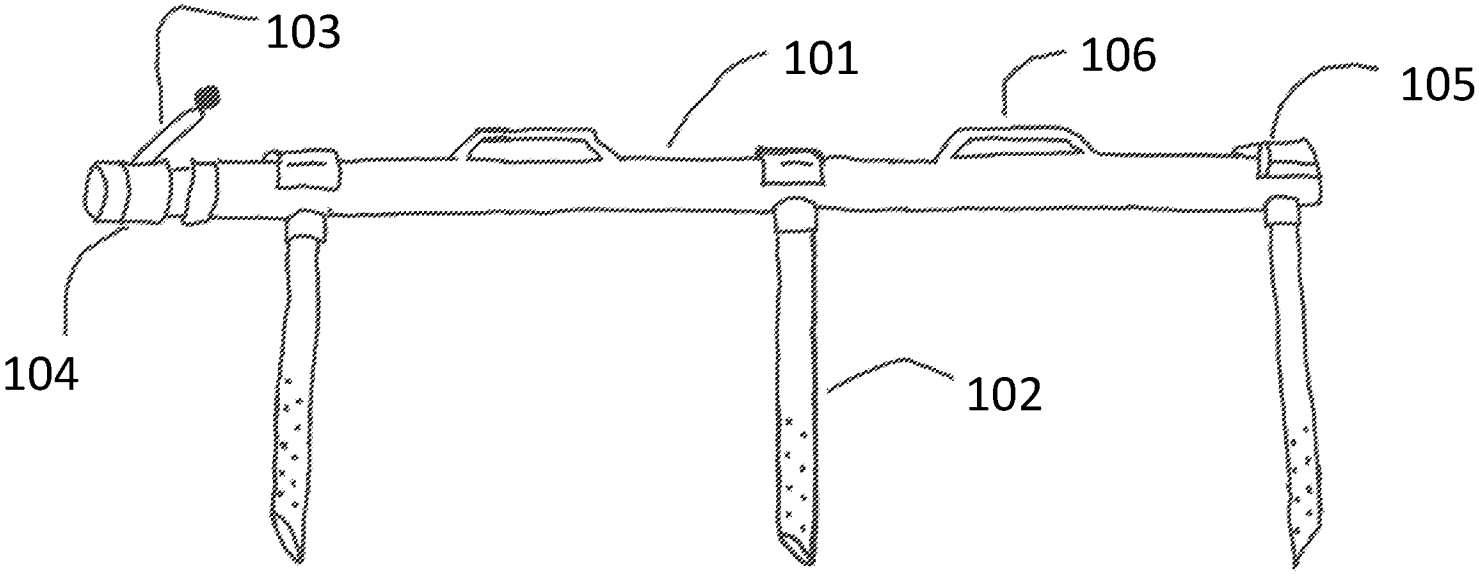
FIG. 1 shows a side perspective of the fire suppression system having three piercing nozzles and a gate valve.
Figure 2:
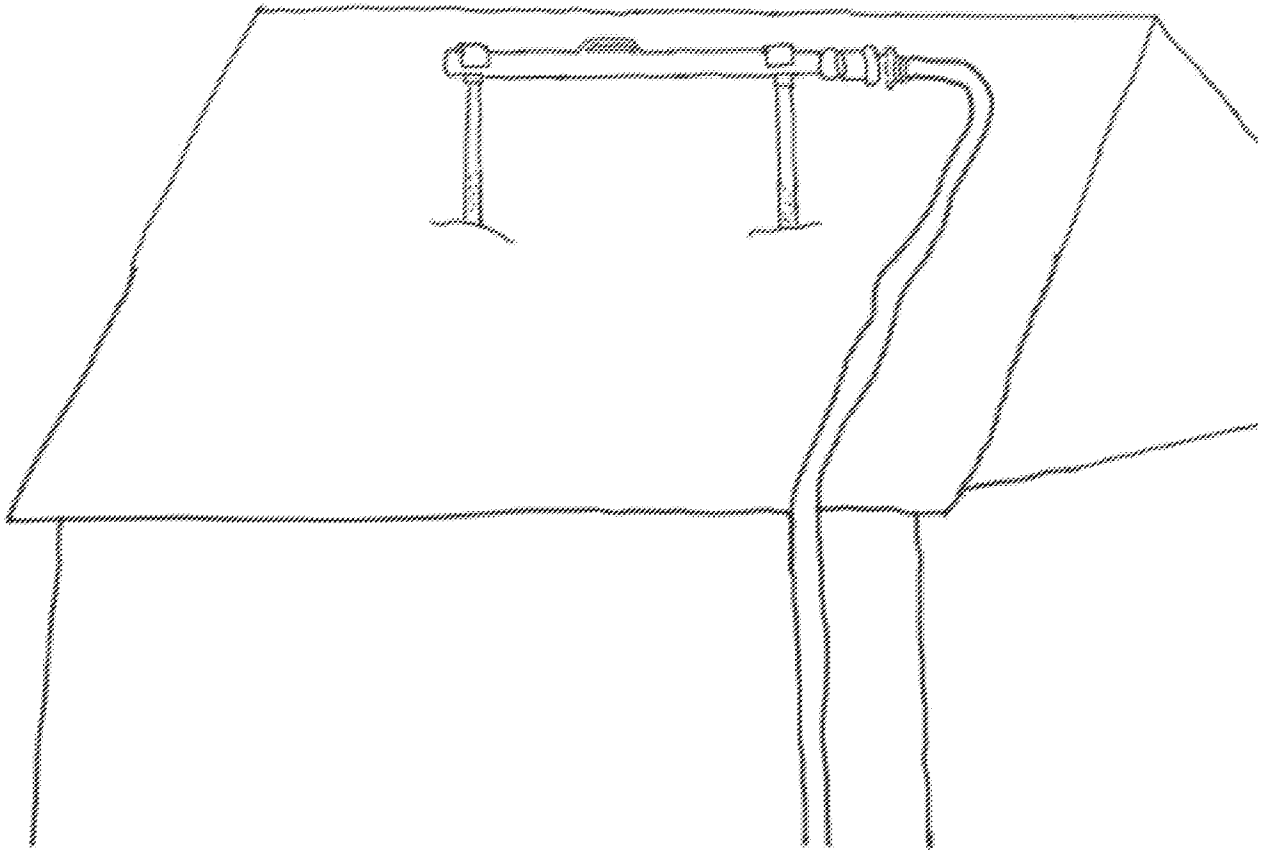
FIG. 2 shows a side perspective view of the fire suppression system that is deployed over a building with the piercing nozzles driven through a roof material.
Figure 3:
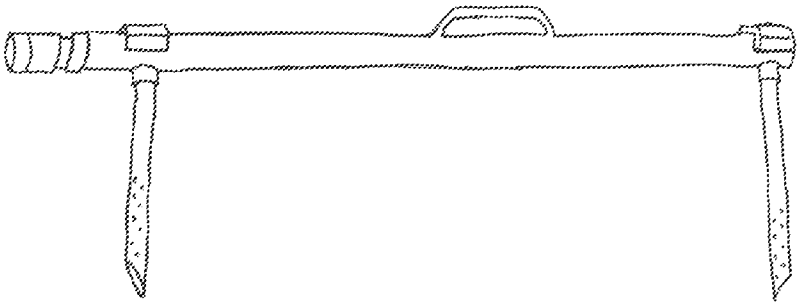
FIG. 3 shows a side perspective of the fire suppression system with two piercing nozzles.
Figure 4:
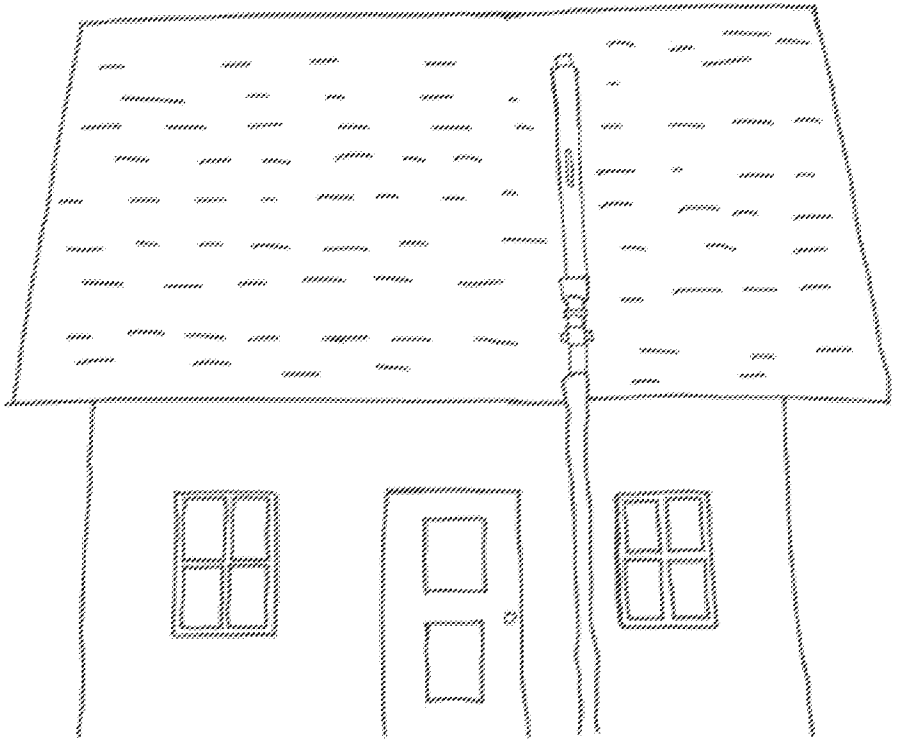
FIG. 4 shows a top perspective view of the fire suppression system that is deployed over a building.
Figures 5A, 5B, 5C:
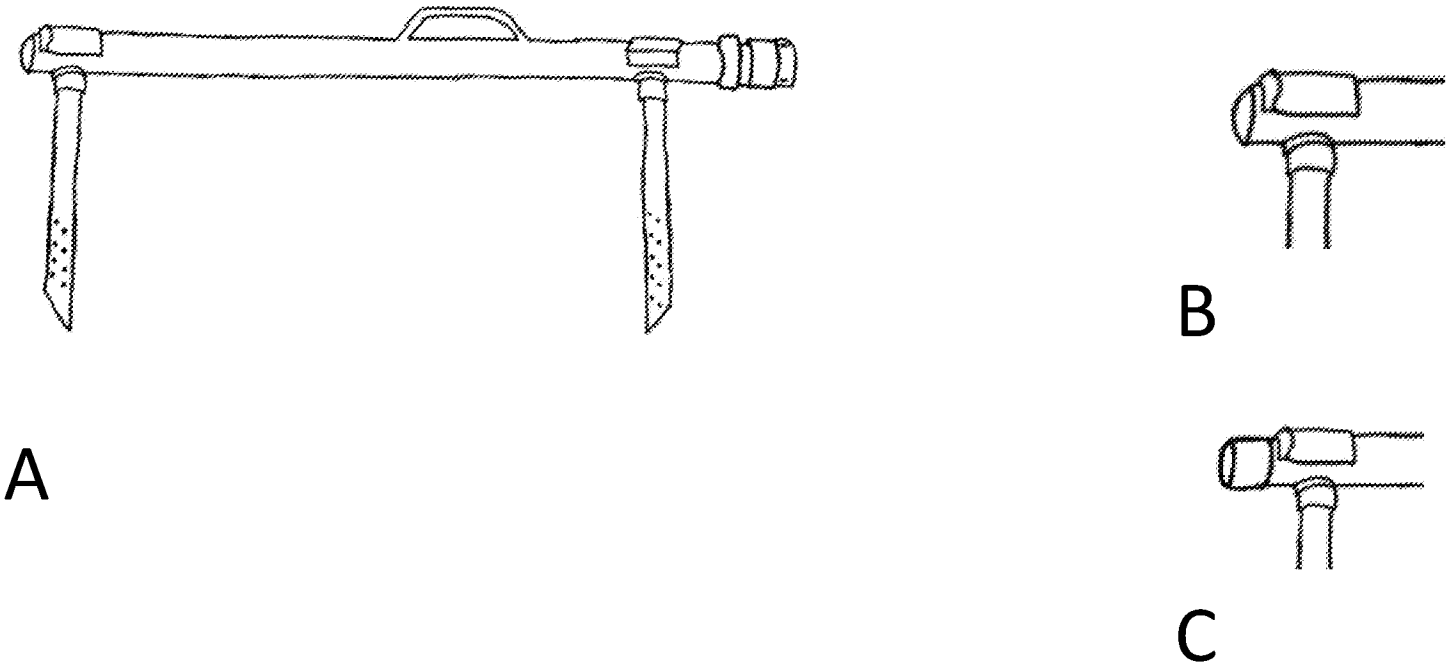
FIGS. 5A-5C show another side perspective of the fire suppression system with two piercing nozzles and enlarged views of the second end of the pipe with different configurations.
Figure 6:
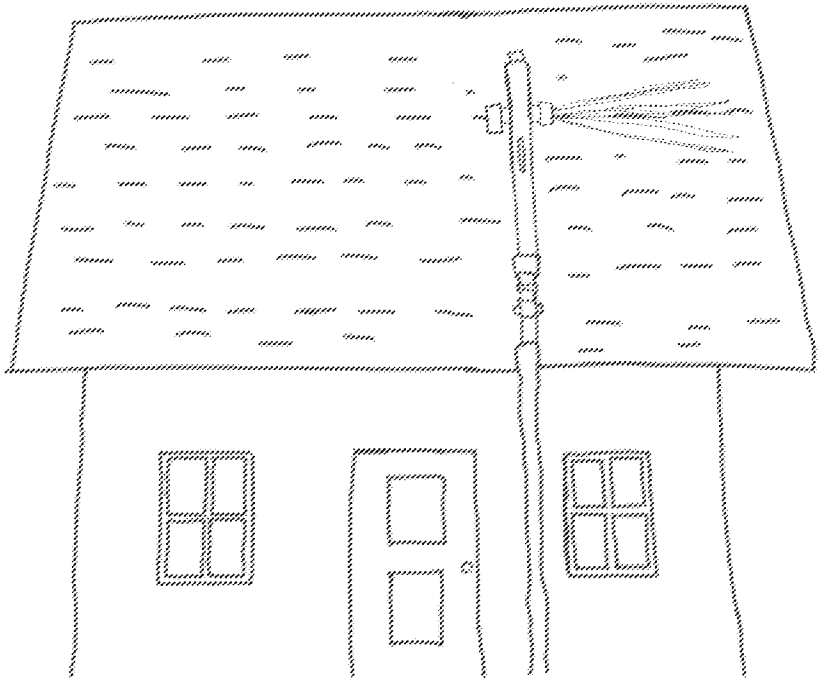
FIG. 6 shows a top perspective of the fire suppression system having one or more outlets diverting water such that the water flows through the system both above the pierced surface (a roof building material) and below the pierced surface (not shown).

The invention is an unmanned fire suppression system containing one or more hoses that connects to a fire hydrant, fire apparatus, or both and one or more pipes. The pipes may have at least one hose coupling to receive the hose on one end, and a cap, a gate valve, and/or enclosure on the other end. The bottom of the pipe has piercing nozzles that extend downward and feature openings for water flow.

The pipe is designed to be deployed in difficult to access areas, including attics, basements, and other void spaces.

The piercing nozzles are capable of being driven through building materials or placed in pre-formed holes and into the enclosed area. These nozzles provide rapid flow of pressurized water. This effectively creates a sprinkler system effect in spaces that do not have sprinkler protection.

In an embodiment, the system is operated autonomously. This provides the necessary fire suppression and lowers the risk to firefighters.

In an embodiment, operating the system includes a coordinated attack. In specific embodiments, the coordinated attack may include ventilation, interior, and transitional attacks.

In an embodiment, operating the system includes a defensive means for protecting exposures from fire spread. Defensive means may include, but are not limited to, providing an intermittent water flow, employing fire retarding foams that penetrate water and/or cling to exposed combustibles, using a water curtain, observing for re-ignition, establishing horizontal and/or vertical collapse zones, and directing water between the fire and areas of exposure to prevent fire extension.

In an embodiment, the system is employed with additional devices that facilitate fire suppression and incident stabilization. These additional devices include, but are not limited to, various types of hoses, handheld nozzles, and fixed appliances.

In an embodiment, the water flow of the system during operation may be modulated for optimal fire attack. In an exemplary embodiment, the water flow rate may range from about 50 gallons per minute (GPM) to over about 500 GPM.

The hose(s) and pipe(s) of the system may vary in diameter based on the purpose of use, flow rate, and the number and type of nozzles. The number of hose(s) and pipe(s) of the system may vary and are not limited in length, width, or height. The system is also not limited in the number and placement of inlets, outlets, couplings, and other fittings.

In an embodiment, the hose coupling(s) may be a threaded coupling, a Storz coupling, or any other suitable fitting as recognized in the art.

In an embodiment, the pipe(s) can be made of various materials and is not limited to any one type. Pipe materials may include, but are not limited to, steel, iron, aluminum, a fire-retardant material, other suitable materials for use in fire suppression, or any combination thereof.

In an embodiment, the pipe(s) may be a rigid straight fixed piece.

In an embodiment, the pipe(s) may be telescoping, folding, collapsible, expandable, or multi-directional.

In an embodiment, the pipe(s) may be modular in length, diameter, material, and in the number of piercing nozzles attached thereto.

In an embodiment, the pipe(s) may have one or more water supply receiving coupling and/or a gate valve to receive and/or control water flow on either or both ends of each pipe.

In an embodiment, the pipe(s) can supply any number of nozzles of various sizes and functions.

The pipe(s) of the system are not limited in water flow rate that reach the nozzles.

In an embodiment, the system can be supplied by various sizes of hoses.

In an embodiment, the pipe(s) further include strike plates for use in driving the nozzles through materials. In a preferred embodiment, the strike plates are made of steel.

In an embodiment, the pipe may include one or more handles for carrying or deploying the system.

In an embodiment, the pipe(s) and hose(s) of the system may be configured or plumbed in any shape or configuration. For example, the pipe can be coupled to a T-shaped fitting/adapter containing three couplings wherein one or more of the three couplings is coupled to the pipe(s) and hose(s) of the system in any desired variation or combination as described herein.

In an embodiment, the pipe(s) further include one or more outlets capable of coupling to a nozzle or a hose line. In a preferred embodiment, the nozzle is a fixed nozzle. In a more preferred embodiment, the one or more outlets are capable of diverting water such that the water flows through the system both below a pierced surface and above the pierced surface. In a more preferred embodiment, the outlets are capable of shutoff such as by using gate valves, ball valves, or any other fitting as recognized in the art.

The piercing nozzles of the system are not limited in function. In an embodiment, the piercing nozzles are capable of piercing and/or penetrating a building material. In an alternative embodiment, the piercing nozzles are non-piercing and/or non-penetrating.

The materials used for making the piercing nozzles are not limited. In an embodiment, piercing nozzle materials include, but are not limited to, one or more combinations of steel, aluminum, iron, polymer materials such as PVC and polycarbonate coated plastics, or other suitable materials that function in the operation of suppressing fires. In a preferred embodiment, the polymer materials are strong enough to withstand extreme conditions and/or are fire/heat resistant.

The piercing nozzles of the system are not limited to any particular shape. In an embodiment, the piercing nozzles of the system are shaped as a pointed tip, jagged edge, cone, other shape useful for piercing and/or penetrating building materials.

The piercing nozzles of the system are not limited in length or diameter. In an embodiment, the nozzle length and diameter may be optimized based on the building material, nozzle material, water pressure, and fire conditions.

In an embodiment, the piercing nozzles of the system are fixed, detachable, foldable, collapsible, telescoping, or any combination thereof.

In an embodiment, the piercing nozzles of the system are adapted to spray any number of non-limiting spray patterns. In a preferred embodiment, the spray pattern is selected from flat fan, hollow cone, full cone, misting, fog steam, and solid stream.

In an embodiment, the piercing nozzles of the system have varying flow rates.

In an embodiment, the piercing nozzles of the system comprise a detachable tip.

In an embodiment, the piercing nozzles of the system are attached via a swivel protruding on an angle away from the pipe(s). In a preferred embodiment, the nozzle(s)/swivel(s) are perpendicular to the pipe(s). In a preferred embodiment, the nozzle(s)/swivel(s) are capable of being rotated and/or directed for use in a fire attack above a pierceable surface such as a roof.

In an embodiment, the system further includes one or more ropes with one or more hooks and/or carabiners. In a preferred embodiment, the one or more carabiners are capable of being attached to a ladder rung such as on a ladder truck. In a preferred embodiment the one or more hooks can be used for hoisting. In a preferred embodiment, the rope(s) are capable of being extended over the edge of a roof. In a preferred embodiment, the system further includes one or more rope retrieval apparatuses capable of retrieving or reeling the rope(s). In a more preferred embodiment, the one or more rope retrieval apparatuses are fixed to the pipe(s) of the system. In a more preferred embodiment, the one or more rope retrieval apparatuses are either fixed or detachable. In a more preferred embodiment, the detachable rope retrieval apparatus(es) can be attached (e.g., by clicking onto) any part of the system.

In an embodiment, one or more sections of the pipe(s) of the system are made of fire hose. In a preferred embodiment, the fire hose sections of the pipe(s) are adapted to connect to one or more piercing nozzle(s) as described herein. Advantageously, the fire hose sections of the pipe(s) allow the system to be easily stored and may be rolled up for compact storage.

In another aspect, the invention includes a method of fighting fires in a building using the system as described herein. The method includes a step of coupling the one or more hoses of the system to one or more water sources. The method further includes a step of positioning the one or more pipes over one or more building areas that enclose a space containing a fire. The method further includes a step of driving the piercing nozzles of the through building material or one or more pre-made holes and into a void space containing a fire. The method further includes a step of operating the system by opening one or more of the water sources and/or one or more gate valves to allow water to flow into the system and out of the piercing nozzles to create a sprinkler effect.

In an embodiment, the operating step of the method is performed unmanned and/or autonomously.

In an embodiment, the operating step of the method further includes a coordinated attack with a ventilation attack, an interior attack, a transitional attack, or any combination thereof.

The system is adaptable and is not limited to a particular location for attacking fires. In an embodiment, the method comprises deploying the system in an area that does not require the use of the piercing nozzles such as at ground level or in an emergency decontamination corridor decontamination zone such as during a hazmat incident.

In an embodiment, the operating step of the method further includes adding a defensive means for protecting exposures from fire spread. Defensive means may include, but are not limited to, providing an intermittent water flow, employing fire retarding foams that penetrate water and/or cling to exposed combustibles, using a water curtain, observing for re-ignition, establishing horizontal and/or vertical collapse zones, and directing water between the fire and areas of exposure to prevent fire extension.

EXAMPLE

An exemplary embodiment of the inventive fire suppression system is shown in FIG. 1, which includes a hose (not shown) and a pipe (101) wherein the hose is coupled to the pipe via a hose coupling (104). The exemplary system contains a series of piercing nozzles (102) arrayed along the same axis and extend downward away from the pipe. The exemplary system further contains strike plates (105) affixed on the opposite side of the pipe for each piercing nozzle in order for driving the piercing nozzle into a building material. The exemplary system further contains handles on the pipe to facilitate positioning of the system (106). The exemplary system further contains a gate valve (103) to open and control water flow into the pipe and out of the piercing nozzles.

One skilled in the art readily appreciates that the present invention is well adapted to carry out the objects and obtain the ends and advantages mentioned, as well as those inherent therein. The details of the description and the examples herein are representative of certain embodiments, are exemplary, and are not intended as limitations on the scope of the invention. Modifications therein and other uses will occur to those skilled in the art. These modifications are encompassed within the spirit of the invention. It will be readily apparent to a person skilled in the art that varying substitutions and modifications may be made to the invention disclosed herein without departing from the scope and spirit of the invention.

The articles "a" and "an" as used herein in the specification and in the claims, unless clearly indicated to the contrary, should be understood to include the plural referents. Claims or descriptions that include "or" between one or more members of a group are considered satisfied if one, more than one, or all of the group members are present in, employed in, or otherwise relevant to a given product or process unless indicated to the contrary or otherwise evident from the context. The invention includes embodiments in which exactly one member of the group is present in, employed in, or otherwise relevant to a given product or process. The invention also includes embodiments in which more than one, or all of the group members are present in, employed in, or otherwise relevant to a given product or process. Furthermore, it is to be understood that the invention provides all variations, combinations, and permutations in which one or more limitations, elements, clauses, descriptive terms, etc., from one or more of the listed claims is introduced into another claim dependent on the same base claim (or, as relevant, any other claim) unless otherwise indicated or unless it would be evident to one of ordinary skill in the art that a contradiction or inconsistency would arise. It is contemplated that all embodiments described herein are applicable to all different aspects of the invention where appropriate. It is also contemplated that any of the embodiments or aspects can be freely combined with one or more other such embodiments or aspects whenever appropriate. Where elements are presented as lists, e.g., in Markush group or similar format, it is to be understood that each subgroup of the elements is also disclosed, and any element(s) can be removed from the group. It should be understood that, in general, where the invention, or aspects of the invention, is/are referred to as comprising particular elements, features, etc., certain embodiments of the invention or aspects of the invention consist, or consist essentially of, such elements, features, etc. For purposes of simplicity those embodiments have not in every case been specifically set forth in so many words herein. It should also be understood that any embodiment or aspect of the invention can be explicitly excluded from the claims, regardless of whether the specific exclusion is recited in the specification.

Where ranges are given herein, the invention includes embodiments in which the endpoints are included, embodiments in which both endpoints are excluded, and embodiments in which one endpoint is included and the other is excluded. It should be assumed that both endpoints are included unless indicated otherwise. Furthermore, it is to be understood that unless otherwise indicated or otherwise evident from the context and understanding of one of ordinary skill in the art, values that are expressed as ranges can assume any specific value or subrange within the stated ranges in different embodiments of the invention, to the tenth of the unit of the lower limit of the range, unless the context clearly dictates otherwise. It is also understood that where a series of numerical values is stated herein, the invention includes embodiments that relate analogously to any intervening value or range defined by any two values in the series, and that the lowest value may be taken as a minimum and the greatest value may be taken as a maximum. Numerical values, as used herein, include values expressed as percentages. For any embodiment of the invention in which a numerical value is prefaced by "about" or "approximately", the invention includes an embodiment in which the exact value is recited. For any embodiment of the invention in which a numerical value is not prefaced by "about" or "approximately", the invention includes an embodiment in which the value is prefaced by "about" or "approximately".

As used herein "A and/or B", where A and B are different claim terms, generally means at least one of A, B, or both A and B.

"Approximately" or "about" generally includes numbers that fall within a range of 1% or in some embodiments within a range of 5% of a number or in some embodiments within a range of 10% of a number in either direction (greater than or less than the number) unless otherwise stated or otherwise evident from the context (except where such number would impermissibly exceed 100% of a possible value). It should be understood that, unless clearly indicated to the contrary, in any methods claimed herein that include more than one act, the order of the acts of the method is not necessarily limited to the order in which the acts of the method are recited, but the invention includes embodiments in which the order is so limited.

What is claimed is:

1. A fire suppression sprinkler system comprising:

one or more hoses and one or more pipes;

wherein the one or more hoses are capable of being coupled to a fire hydrant, a fire apparatus, or a combination thereof;

wherein each of the one or more pipes comprises a first end, a second end, and a plurality of piercing nozzles arrayed and extending downward away from and along each of the one or more pipes;

wherein the first end comprises a first hose coupling capable of receiving one end of the one or more hoses;

wherein the second end comprises at least one of a cap, a gate valve, a second coupling or an enclosure;

wherein each of the piercing nozzles comprise a plurality of water flow openings for providing a sprinkler effect;

wherein each of the one or more pipes further comprise a plurality of strike plates affixed directly to the pipe on a side of the pipe opposite each piercing nozzle to facilitate driving each piercing nozzle into a building material;

wherein the one or more hoses, the one or more pipes, the first hose coupling, the plurality of piercing nozzles, and at least one of the gate valve or the second coupling of the fire suppression sprinkler system are capable of delivering over 500 gallons of water per minute to facilitate fire suppression and incident stabilization; and wherein the one or more pipes further comprise one or more handles.

2. The system of claim 1, wherein each of the one or more pipes is made from steel, iron, aluminum, a fire-retardant material, a polymer material, or any combination thereof.

3. The system of claim 1, wherein one or more of the plurality of piercing nozzles are detachable or fixed.

4. The system of claim 1, wherein one or more of the plurality of piercing nozzles are foldable, collapsible, telescoping, or any combination thereof.

5. The system of claim 1, wherein the system comprises one or more flow control devices adapted to modulate spray flow rate selected from the group consisting of gate valves and ball valves.

6. The fire suppression system of claim 1, wherein the piercing nozzles comprise a detachable tip.

7. The fire suppression system of claim 1, wherein one or more piercing nozzles are adapted to spray one or more spray patterns selected from the group consisting of flat fan, hollow cone, full cone, misting, fog steam, and solid stream.

8. The fire suppression system of claim 1, wherein the one or more pipes further comprises at least one outlet capable of coupling to a nozzle or a hose line and wherein the at least one outlet is capable of diverting water through the system either below a pierced surface or above the pierced surface.

9. The fire suppression system of claim 1, wherein the first end further comprises a gate valve or a ball valve.

10. A method of fighting fires in a building comprising the steps of coupling the one or more hoses of the system of claim 1 to one or more water sources, positioning the one or more pipes of the system of claim 1 over one or more building areas that enclose a space containing a fire, driving the piercing nozzles of the system of claim 1 through building material or through one or more pre-made holes and into a void space containing a fire, and operating the system by opening one or more of the water sources and/or one or more gate valves to allow water to flow into the system and out of the piercing nozzles to create a sprinkler effect.

11. The method of claim 10, wherein the operating step is performed unmanned and/or autonomously.

12. The method of claim 10, wherein the operating step further comprises a coordinated attack with a ventilation attack, an interior attack, a transitional attack, or any combination thereof.

13. The method of claim 10, wherein the operating step further comprises adding a defensive means for protecting exposures from fire spread.

14. The fire suppression system of claim 8, wherein the at least one outlet comprises at least two outlets capable of coupling to a nozzle or a hose line, and wherein the at least two outlets in combination are capable of diverting water through the system below the pierced surface, or both below and above the pierced surface.

* * * * *